US005839290A

United States Patent [19]

Nazeri

[11] Patent Number: 5,839,290

[45] Date of Patent: Nov. 24, 1998

[54] ORGANIC/INORGANIC COMPOSITE WICKS FOR CAILLARY PUMPED LOOPS

[75] Inventor: Azar Nazeri, Columbia, Md.

[73] Assignee: United States of America as Represented by the Secretary of the Navy

[21] Appl. No.: 787,724

[22] Filed: Jan. 24, 1997

[51] Int. Cl.[6] ..... F28D 15/00; F25D 15/00

[52] U.S. Cl. ..... 62/119; 62/114; 165/104.26

[58] Field of Search ..... 62/467, 515, 524, 62/525, DIG. 12, 119, 114; 165/104.21, 104.26, 905, 907; 428/411.1, 373, 446, 447

[56] References Cited

U.S. PATENT DOCUMENTS

| | | | |
|---|---|---|---|
| 4,883,116 | 11/1989 | Seidenberg et al. | 165/104.26 |
| 4,890,668 | 1/1990 | Cima | 165/104.25 |
| 5,116,703 | 5/1992 | Basheda et al. | 430/59 |
| 5,316,855 | 5/1994 | Wang et al. | 428/447 |
| 5,384,376 | 1/1995 | Tunney et al. | 525/431 |
| 5,398,840 | 3/1995 | Luhman et al. | 220/563 |
| 5,441,682 | 8/1995 | Baker et al. | 264/82 |
| 5,555,914 | 9/1996 | Baker et al. | 138/115 |

OTHER PUBLICATIONS

J.E. Mark et al., "Polymer–modified silica glasses", Polymer Bull, 18 259–64 (1987).

S. Kohjiya et al., "Preparation of Inorganic/Organic Hybrid Gels by the Sol–Gel Process", J. Non–Crystalline Solids 119 132–35 (1990).

*Primary Examiner*—William Doerrler

*Attorney, Agent, or Firm*—Thomas E. McDonnell; John J. Karasek

[57] ABSTRACT

An evaporator for a capillary pumped loop, has: (a) a tubular wick for containing coolant liquid centrally therein, the body of the wick being saturated with the liquid coolant; (b) a tubular heat exchanger for receiving said wick; and (c) one or more longitudinal vapor channels between said wick and said heat exchanger, for transporting a vapor of the working liquid out of the evaporator; where this tubular wick comprises a porous organic/inorganic composite made by the sol-gel process. By replacing the conventional polyethylene wick with the composite wick, smaller pores, greater porosity, greater thermal stability, and other advantages are secured.

19 Claims, 2 Drawing Sheets

ORGANIC/INORGANIC COMPOSITE WICKS FOR CAILLARY PUMPED LOOPS

BACKGROUND OF THE INVENTION

1. Field of the Invention

The present invention relates to an improved evaporator section for a capillary pumped loop, and more particularly to an evaporator section for a capillary pumped loop using a inorganic/organic composite wick.

2. Description of the Related Art

Passive cooling systems, unlike conventional refrigerators, do not require the use of mechanical pumping to circulate the coolant. They are typically used in applications where one or more of the features of conventional refrigerators (power demand by the pump, heating from the pump, vibration from the pump, size and weight of the pump) are unacceptable.

A capillary pumped loop (CPL) is a particular type of passive cooling system. A simple CPL is depicted in FIG. 1. In a CPL 10, a waste heat source 11 is in thermal contact with one or more evaporators 12. The liquid coolant 13 absorbs heat from the waste heat source 11, and undergoes a liquid-to-vapor phase change in the evaporator 12. Coolant vapor 14 from the evaporator 12 travels through the vapor line 15 to the condenser 16, where the vapor 14 condenses to the liquid phase 13, transferring heat to the heat sink 17 (typically some type of radiator). The liquid coolant 13 then travels through the liquid line 18 back to the evaporator(s) 12, where the cycle repeats.

A critical component in the CPL 10 is the evaporator 12, a typical example of which is shown in cross section in FIG. 2. The evaporator 12 has a porous wick 20 separating the liquid phase 13 of the coolant (typically ammonia) from the vapor phase 14 of the coolant. The liquid coolant 13 moves from the center 21 of the evaporator 12 through the porous wick 20 by capillary force. Upon reaching the outer surface 22 of the wick 20, the fluid vaporizes, absorbing heat. The capillary force through the wick 20 provides the pumping for the coolant through the CPL 10. Between the wick 20 and the evaporator tube wall 23 are one or more channels 24 (typically longitudinal to the evaporator, as shown) for the vapor phase 14 of the coolant to flow out of the evaporator 12, and into a vapor line, and subsequently to the condenser.

To date, the largest hurdle to the wide-scale implementation of CPL technology has been the lack of satisfactory wicks. In the U.S., the most common wick material in use is polyethylene, with an average pore diameter of 15 $\mu$m. This pore size is too large to maintain an adequately large pressure gradient across the wick. Consequently, these wicks suffer from poor performance. These wicks also have low porosity, on the order of 30%–50%. They have poor thermal stability, to only about 80° C. They also have poor plasticity and machinability, both of which are desirable properties for fabricating wicks. Furthermore, production of these porous polyethylene wicks has proven to be inconsistent.

Metal wicks are also in use. These metal wicks typically have average pore sizes of 1 to 2 $\mu$m, resulting in 15 times greater pressure head than has been achieved with polyethylene (pressure head through the wick is proportional to the inverse of the pore diameter in the wick). However, these wicks are much heavier than polyethylene wicks, and are thermally conductive. Thermal conductivity can lead to vaporization of the coolant within the core of the evaporator, rather than only at the outer surface of the wick. Vapor formation within the core of the evaporator can lead to "deprime" of the CPL, and loss of pumping action. Another disadvantage of the metal wicks is their rigidity. Frequently, it is desired to have evaporators with irregular shapes, to fit into relatively confined spaces near heat sources. Fabricating these evaporators is much simpler if the wick material is at least partially flexible.

Thus, a desirable wick material would have small pores, with pore sizes that could be selected for appropriateness for particular applications. A desirable wick material would also be flexible, light weight, thermally stable (greater than the 80° C. stability of polyethylene), thermally insulating, and compatible with the coolant used in the CPL. The desirable wick material would also be highly porous (greater than the 50% porosity of polyethylene), to minimize weight and maximize coolant throughput (and thus cooling action) without sacrificing pressure head across the wick. This desirable wick material would also have good plasticity and machinability. Finally, since this wick material should fit snugly into an evaporator tube, it would be advantageous for the wick material to be slightly expandable in some manner after it is inserted into the evaporator tube.

SUMMARY OF THE INVENTION

Accordingly, it is an object of this invention to provide an improved evaporator for a capillary pumped loop, where this evaporator has an improved wick, the wick having small pores, the size of the pores being controllable, high porosity, high thermal stability, low thermal conductivity, low density, good plasticity and machinability, and compatibility with the working fluid of the capillary pumped loop.

These and additional objects of the invention are accomplished by the structures and processes hereinafter described.

The present invention is an evaporator for a capillary pumped loop, having: (a) a tubular wick for containing a coolant liquid flow centrally therein, the body of the wick being saturated with the coolant liquid; (b) a tubular heat exchanger for receiving the wick; and (c) one or more vapor channels between the wick and the heat exchanger, for transporting a vapor of the coolant out of the evaporator; where this tubular wick comprises a porous organic/inorganic composite.

BRIEF DESCRIPTION OF THE DRAWINGS

A more complete appreciation of the invention will be obtained readily by reference to the following Description of the Preferred Embodiments and the accompanying drawings in which like numerals in different figures represent the same structures or elements, wherein.

DETAILED DESCRIPTION OF THE PREFERRED EMBODIMENTS

The following are incorporated by reference herein, in their entireties, for all purposes:

(a) U.S. Pat. No. 5,116,703, "Functional hybrid compounds and thin films by sol-gel process", issued May 26, 1992 to Badesha et al.;

(b) U.S. Pat. No. 5,316,855, "High abrasion resistance coating materials from organic/inorganic hybrid materials produced by the sol-gel method", issued May 31, 1994 to Wang et al.;

(c) U.S. Pat. No. 5,384,376, "Organic/inorganic hybrid materials", issued Jan. 24, 1995 to Tunney et al.;

(d) J. E. Mark et al., "Polymer-modified silica glasses", Polymer Bull. 18 259–64 (1987);

(e) S. Kohjiya et al., "PREPARATION OF INORGANIC/ORGANIC HYBRID GELS BY THE SOL-GEL PROCESS", J. Non-Crystalline Solids 119 132–35 (1990).

Figure 1:
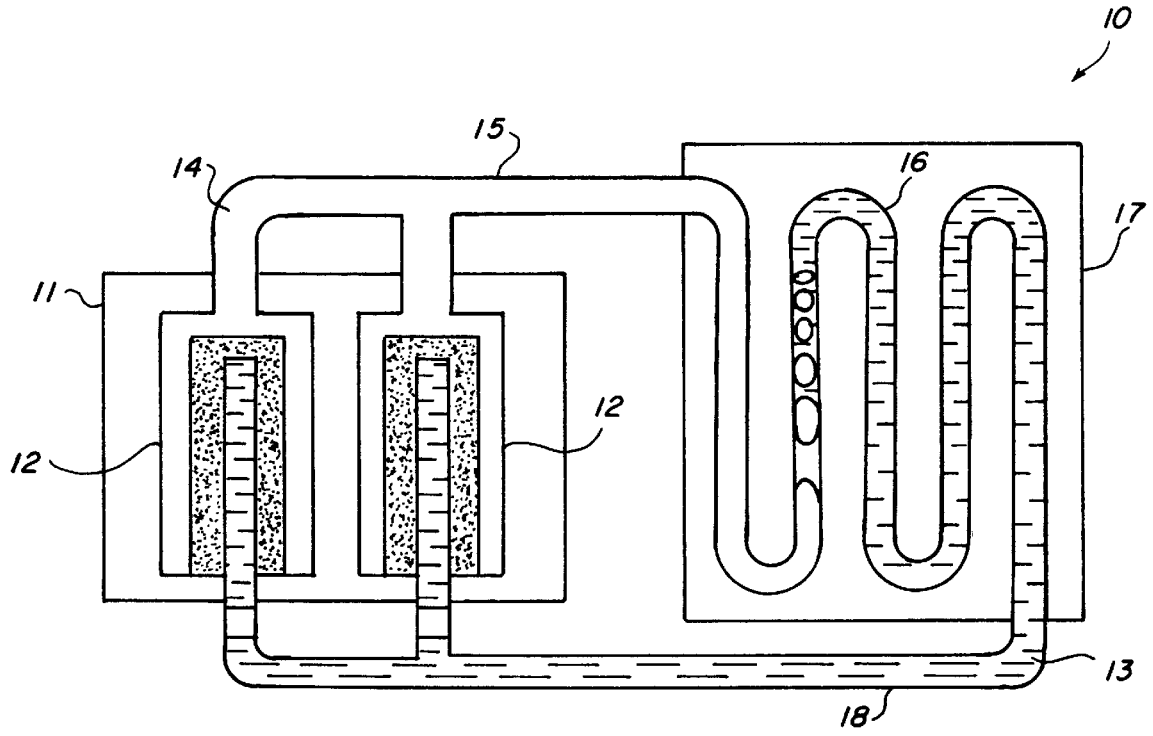
PRIOR ART FIG. 1
FIG. 1 is a schematic view of a typical capillary pumped loop cooling system.
Figure 2:
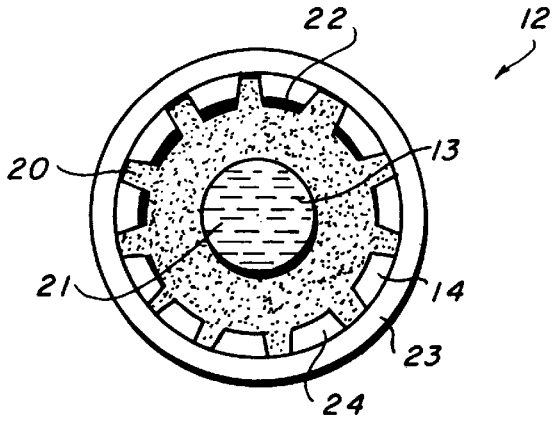
PRIOR ART FIG. 2
FIG. 2 is a cross sectional view of an evaporator section of a capillary pumped loop cooling system.
Figure 3:
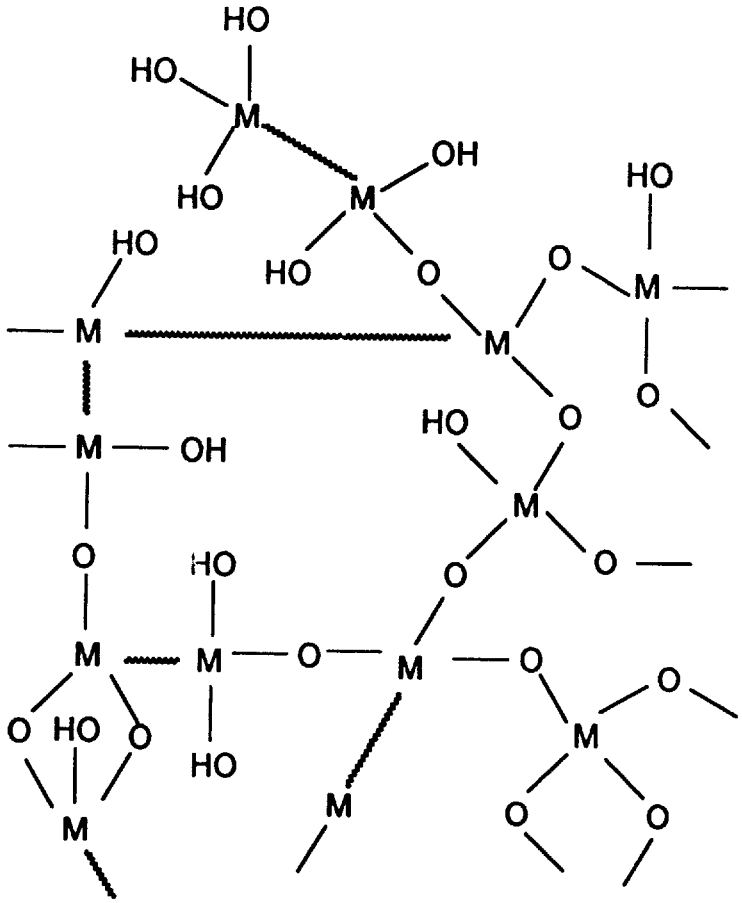
FIG. 3 is a structural diagram of a typical organic/inorganic composite for use in a wick for an evaporator according to the invention.

As depicted in FIG. 3, organic/inorganic composites have a network structure, where finely-defined regions of inorganic material are bonded to finely defined regions of organic polymers. The composites form a three-dimensional network.

The inorganic phase of the organic/inorganic composites will typically be in the form of metal oxides, such as silica, alumina, zirconia, titania, and combinations thereof. They will typically have precursors with repeating units of the structure:

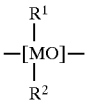

where M is a metal, and where $R^1$ and $R^2$ are independently selected. $R^1$ and $R^2$ are typically H or OH, but they may also be small organic ligands bonded to the inorganic backbone, such as aliphatic groups having 10 or fewer carbons, and aromatic groups having 10 or fewer carbons, and combinations thereof. In the later case, typical small organic ligands include $CH_3$, $CH_2CH_3$, propyl, isopropyl, phenyl, and vinyl groups, and combinations thereof.

The organic phase of the organic/inorganic composites will typically be in the form of linear polymers, most typically polydimethylsilane. Other typical polymers for the organic phase include polyethylene glycol, poly (alkylmethacrylate), dialkoxysilanes, trialkoxysilanes, and combinations thereof.

Morphologically, these composites cam form gels having pores ranging in average size from about 0.1 $\mu$m (or less), to about 20 $\mu$m. The pore size is controllable within this approximate range by selection of the processing conditions, as shown below. The porosity of the composites (void volume/sample volume) will typically be between about 20% and about 80%. Larger porosity will increase the coolant throughput, and thus the cooling capacity, of the wick, but will decrease the strength of the wick. The porosity is likewise controllable within this approximate range by selection of the processing conditions.

Preferred pore sizes for the composites of the invention are preferably less than 20 $\mu$m, more preferably less than 5 $\mu$m, still more preferably less than 1.0 $\mu$m, and most preferably less than 0.7 $\mu$m. Pore sizes of 0.3 $\mu$m, 0.2 $\mu$m, and 0.1 $\mu$m are achievable by the present invention. As noted above, decreasing wick pore size is associated with improved pressure inventory, and hence improved evaporator performance.

Porosities greater than the 30%–50% available from polyethylene are achievable by the present invention. As a practical matter, however, there will be an upper limit on porosity due to the need for a certain minimum strength to the wick. Accordingly, porosities for the composites of the present invention are typically between about 50% and about 95%, more typically between about 55% and about 90%, preferably between about 60% and about 85%, and more preferably between about 65% and about 80%.

Skilled practitioners will recognize that organic/inorganic composites may be made by the sol-gel method. In this method, an organic precursor and an inorganic precursor (for the respective organic and inorganic phases) undergo concurrent hydrolysis and polycondensation reactions. For example, the hydrolysis and polycondensation of tetraethoxysilane (TEOS) and polydimethylsiloxane (PDMS) will proceed as:

Hydrolysis:

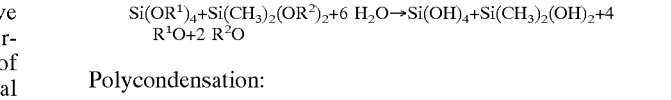

$$Si(OR^1)_4+Si(CH_3)_2(OR^2)_2+6\ H_2O \rightarrow Si(OH)_4+Si(CH_3)_2(OH)_2+4\ R^1O+2\ R^2O$$

Polycondensation:

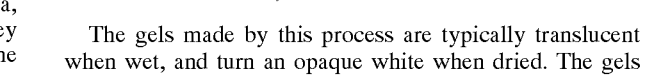

$$Si(OH)_4+HO—(Si(CH_3)_2—O—)—H \rightarrow —(—O—)Si—O—(Si(CH_3)—O—)_y—Si(—O—)_3+\ldots$$

The gels made by this process are typically translucent when wet, and turn an opaque white when dried. The gels made by this process typically shrink slightly when dried. A unique and useful feature of wicks made from these gels is that they are wettable by alcohols, and swell by a few vol % upon wetting by alcohols (swelling up to 4 vol % has been observed), despite being hydrophobic. This feature is exploitable in making CPL evaporators, in that a wick for a CPL evaporator may be made with an outside diameter (OD) that is slightly (a few %) smaller than the inner diameter (ID) of the evaporator tube. Thus, the wick is easily inserted into the evaporator tube. After insertion, the wick is wet by alcohol, to cause the wick to swell slightly, forming a snug fit between the wick and the evaporator tube.

It has been discovered that by varying the processing conditions, in particular by varying the acid treatment during the sol-gel process, composites of varying pore size and porosity can be made. Generally speaking, additional acid treatment leads to composites with composites with very fine particle sizes and high porosity. Also, additional acid treatment speeds up the reaction. Also, varying the reaction temperature will affect the morphology of the samples. Generally, finer grained composites are made at lower processing temperatures.

Varying the ratio of inorganic to organic material will affect the material properties of the composite. Generally speaking, the resiliency of the composite will increase with the fraction of the composite that is organic, and the brittleness of the composite will increase with the fraction of the composite that is inorganic. Typically, composites according to the invention will be between about 20% and about 80% inorganic. More typically, composites according to the invention will be between about 40% and about 70% inorganic. Most typically, composites according to the invention will be between about 55% and about 65% inorganic.

It has been discovered that the composites of the present invention are much more thermally stable than polyethylene wicks. Stability to 200° C. has been observed, a 120° C. improvement over polyethylene. This opens up the possibility to the use of other working fluids that have boiling points above 80° C.

Having described the invention, the following examples are given to illustrate specific applications of the invention, including the best mode now known to perform the invention. These specific examples are not intended to limit the scope of the invention described in this application.

EXAMPLE 1

Solution A: 30 grams of tetraethoxyorthosilicate was mixed with 20 grams of polydimethylsilane. 15 ml of isopropanol was added to the mixture, followed by 10 ml of tetrahydrofuran. This solution was mixed at room temperature and then stirred in a water bath at a constant elevated temperature (50° C. and 70° C. in various runs).

Solution B: 25 ml of isopropanol, 7.77 grams of deionized water, and 1.2 ml of 12M HCL were mixed together, and added to Solution A, gradually.

The mixture was stirred at constant 70° C. temperature for a reaction time that varied from 10–50 minutes for various runs. In some runs, additional acid, in the form of concentrated hydrofluoric acid (less than a gram) was added to the solution.

After reaction, the solution was poured into molds and kept in a 70° C. oven for 48 hours. The solution gelled in the oven. The solution was taken out of the oven, and kept at room temperature for an extended period (up to two weeks). The gels were taken out of the molds and dried at room temperature for several days, and then at elevated temperature (120° C.).

The properties of three samples of organic/inorganic composite wicks according to the present invention are tabulated below, with the properties of a conventional polyethylene wick for comparison.

TABLE 1

Properties of a Polyethylene Wick and Gel Wicks.

| Sample | Bulk Density[1] ($K/m^3$) | Apparent Density[2] ($K/m^3$) | Porosity (%) | Pore Size ($\mu m$) | Swelling (vol %) |
|---|---|---|---|---|---|
| polyethylene | 650 | 880 | 27 | 15–20 | 0 |
| R20 | 330 | 1150 | 71 | 3–5 | 2 |
| R30D | 280 | 1200 | 77 | 10–15 | 3 |
| R50 | 530 | 1180 | 55 | 0.2–0.5 | 2 |

[1]Measured density of porous gel.
[2]Inherent density of the material porosity is 1 - BD/AD).

Sample R20 was prepared by reacting the organic and inorganic components in the hot bath for 20 minutes, and was catalyzed with only one acid (HCL). Sample R30D was prepared by reacting the organic and inorganic components in the hot bath for 30 minutes, and was catalyzed with two acids (HCL and HF). Sample R50 was prepared at a lower temperature than the other samples (50° C. vs. 70° C.). It was reacted for 50 minutes, and was catalyzed with one acid (HCL).

Scanning electron microscopy of the samples show a microstructure that varies with processing conditions. Samples R20 and R30D, prepared at higher temperatures, had coarser morphologies than sample R50. However, all the gel-wick samples had much finer structures than the polyethylene wick.

Obviously, many modifications and variations of the present invention are possible in light of the above teachings. It is therefore to be understood that, within the scope of the appended claims, the invention may be practiced otherwise than as specifically described.

What is claimed is:

1. An evaporator for a capillary pumped loop, comprising:

a tubular wick for containing liquid coolant centrally therein, the body of said wick being saturated with said liquid coolant;

a tubular heat exchanger for receiving said wick;

one or more vapor channels between said wick and said heat exchanger, for transporting a vapor of said coolant out of said evaporator;

wherein said tubular wick comprises a porous organic/inorganic composite.

2. The evaporator of claim 1, wherein said porous organic/inorganic composite has a porosity of between about 50% and about 80%.

3. The evaporator of claim 1, wherein said porous organic/inorganic composite has a porosity of between about 55% and about 80%.

4. The evaporator of claim 1, wherein said porous organic/inorganic composite has a porosity of between about 60% and about 75%.

5. The evaporator of claim 1, wherein said porous organic/inorganic composite has a porosity of between about 65% and about 70%.

6. The evaporator of claim 1, wherein said porous organic/inorganic composite has an average pore size of between about 0.1 $\mu m$ and 20 $\mu m$.

7. The evaporator of claim 1, wherein said porous organic/inorganic composite has an average pore size of between about 0.1 $\mu m$ and 5 $\mu m$.

8. The evaporator of claim 1, wherein said porous organic/inorganic composite has an average pore size of between about 0.2 $\mu m$ and 1.0 $\mu m$.

9. The evaporator of claim 1, wherein said porous organic/inorganic composite has an average pore size of between about 0.3 $\mu m$ and 0.7 $\mu m$.

10. The evaporator of claim 1, wherein said porous organic/inorganic composite is made by a sol-gel process.

11. The evaporator of claim 1, wherein said porous organic/inorganic composite has an organic component with a repeating unit having the structure

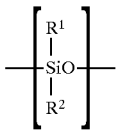

wherein $R^1$ and $R^2$ are independently selected from the group consisting of H, OH, aliphatic groups having 10 or fewer carbons, and aromatic groups having 10 or fewer carbons.

12. The evaporator of claim 11, wherein $R^1$ and $R^2$ are independently selected from the group consisting of H, $CH_3$, $CH_2CH_3$, propyl, isopropyl, phenyl, and vinyl.

13. The evaporator of claim 1, wherein said porous organic/inorganic composite has a polymer component selected from the group consisting of polydimethylsilane, polyethylene glycol, and poly(alkylmethacrylate), and combinations thereof.

14. The evaporator of claim 1, wherein said porous organic/inorganic composite has a polymer component selected from the group consisting of dialkoxysilanes, trialkoxysilanes, and combinations thereof.

15. The evaporator of claim 1, wherein said porous organic/inorganic composite has an inorganic component having a primary component selected from the group consisting of silica, zirconia, alumina, titania, and combinations thereof.

16. The evaporator of claim 1, wherein said porous organic/inorganic composite has an inorganic component having the structure $MO_n$, wherein M is selected from the group consisting of Si, Zr, Al, Ti, and combinations thereof, and wherein n is governed by the valence of M.

17. The evaporator of claim 1, wherein said porous organic/inorganic composite has a precursor for the inorganic phase having repeating units of the formula:

$$M(OR)_x$$

wherein M is a metal, and wherein R groups are independently selected from the group consisting of H, OH, aliphatic groups having 10 or fewer carbons, and aromatic groups having 10 or fewer carbons, and combinations thereof, and wherein x is governed by the valence of M.

18. The evaporator of claim 1, wherein said porous organic/inorganic composite is stable at a temperature in excess of 80° C.

19. The evaporator of claim 1, wherein said porous organic/inorganic composite is stable at a temperature in excess of about 200° C.

* * * * *